US006079871A

United States Patent [19]

Jonas et al.

[11] Patent Number: 6,079,871

[45] Date of Patent: Jun. 27, 2000

[54] METHOD AND DEVICE FOR COMBINING AT LEAST TWO FLUID MEDIA

[75] Inventors: Konrad H. Jonas, Duesseldorf; Hansjoerg Maier, Waghausel; Klaus Langendorf, Dudenhofen, all of Germany

[73] Assignee: Henkel-Teroson GmbH, Heidelberg, Germany

[21] Appl. No.: 08/722,267

[22] PCT Filed: Apr. 7, 1995

[86] PCT No.: PCT/DE95/00462

§ 371 Date: Dec. 5, 1996

§ 102(e) Date: Dec. 5, 1996

[87] PCT Pub. No.: WO95/27558

PCT Pub. Date: Oct. 19, 1995

[30] Foreign Application Priority Data

Apr. 9, 1994 [DE] Germany ..... 44 12 261
Mar. 3, 1995 [DE] Germany ..... 195 07 448

[51] Int. Cl.[7] ..... B01F 5/06

[52] U.S. Cl. ..... 366/336; 206/219; 222/145.6

[58] Field of Search ..... 366/69, 129, 130, 366/162.1, 177.1, 181.5, 189, 336–341, 348, 349; 206/219, 221; 222/145.1, 145.5, 145.6

[56] References Cited

U.S. PATENT DOCUMENTS

| | | | |
|---|---|---|---|
| 3,159,312 | 12/1964 | Van Sciver, II | 366/336 |
| 3,266,671 | 8/1966 | Gelpey . | |
| 3,367,542 | 2/1968 | Madison . | |
| 3,390,814 | 7/1968 | Creighton et al. . | |
| 3,730,394 | 5/1973 | Woodson | 366/130 |
| 3,806,097 | 4/1974 | Devellian et al. . | |
| 4,197,020 | 4/1980 | Doherty . | |
| 4,736,769 | 4/1988 | Belanger . | |
| 4,742,087 | 5/1988 | Kluth et al. . | |
| 4,974,634 | 12/1990 | Agulia . | |
| 4,986,443 | 1/1991 | Saur et al. . | |
| 4,995,540 | 2/1991 | Colin et al. . | |
| 5,129,730 | 7/1992 | Someah et al. . | |
| 5,310,091 | 5/1994 | Dunning et al. . | |

FOREIGN PATENT DOCUMENTS

| | | |
|---|---|---|
| 133 143 | 2/1985 | European Pat. Off. . |
| 313 519 | 4/1989 | European Pat. Off. . |
| 351 358 | 1/1990 | European Pat. Off. . |
| 1 027 597 | 5/1953 | France . |
| 23 59 839 | 6/1974 | Germany . |
| 36 26 223 | 2/1988 | Germany . |
| 39 13 409 | 10/1990 | Germany . |
| 41 19 484 | 12/1992 | Germany . |
| 4 202 591 | 8/1993 | Germany . |
| 92 18 334 | 4/1994 | Germany . |
| 936 957 | 9/1963 | United Kingdom . |
| 986 481 | 3/1965 | United Kingdom . |
| 2 004 761 | 4/1979 | United Kingdom . |
| 2 086 248 | 5/1982 | United Kingdom . |
| 2 246 172 | 1/1992 | United Kingdom . |
| 95/00572 | 1/1995 | WIPO . |

*Primary Examiner*—Charles E. Cooley
*Attorney, Agent, or Firm*—W. C. Jaeschke; Daniel S. Ortiz

[57] ABSTRACT

The invention is a device and a method for combining at least two fluid media. The device comprises a flow region (1) which is attached to and/or formed with an opening of a first chamber (2) and which is designed to accommodate the fluid medium coming from the first chamber and to transport it to the outlet (3) of the flow region (1) which is preferably followed by a mixing zone. A second chamber (9) designed to be filled with a second fluid medium is connected to the flow region and/or to the first chamber through at least one first opening element (inlet opening) (11) for diverting part of the first fluid medium from the first into the second chamber. The second chamber is provided with at least one second opening element (second opening) (12) opening into or adjoining the flow region (1) for discharging the second fluid medium displaced into it by the first fluid medium. Several first chambers (2) or second chambers (9) may be provided.

44 Claims, 5 Drawing Sheets

METHOD AND DEVICE FOR COMBINING AT LEAST TWO FLUID MEDIA

FIELD OF THE INVENTION

This invention relates to a device for combining at least two fluid media comprising at least one first chamber designed to be filled with a first fluid medium and at least one flow region which is designed to be attached in the vicinity of an opening of the first chamber, being connected thereto, and to accommodate the first fluid medium issuing from the first chamber and to transport it to an outlet opening of the flow region and to a method for producing a strand of product by combining at least two separately stored fluid media.

DISCUSSION OF RELATED ART

In many applications, the problem of combining at least two separately stored fluid media in such a way that they are mixed together immediately before application to form a multicomponent system arises. Examples include the combination of the two components of so-called two-component adhesives and the mixing of sealing compounds with colouring substances. Broadly speaking, this problem may be summarized to mean that at least one second fluid medium has to be added to a first fluid medium to modify the properties of the fluid media, for example their viscosity, mechanical and/or chemical properties, appearance or physical states. The media may be two-component or multicomponent systems, although they must be capable of flow in accordance with the invention, their optionally different viscosity being of secondary importance.

Numerous formulations for one-component or multicomponent sealants and/or adhesives are already known, being used for bonding and/or sealing structural components of metal, wood, glass or plastics in vehicle construction, aircraft construction or general machine construction. Users generally prefer one-component systems because they can be used with simple applicators and because they are not susceptible to mixing or metering errors which can adversely affect the final properties of the bond or seal. In many cases, however, the reaction rate of one-component systems is not sufficient to build up the required ultimate strength or even a minimum strength, so that conventional two-component systems are still used in cases such as these. In order to reduce the effects of possible mixing errors, the two components have equally large volumes and viscosities. However, this means that special two-component application systems are required for such two-component systems. Examples of two-component application systems are the co-axial cartridges preceded by a static mixer which are available under the name of "Supermix" from Liquid Control. In addition, two-component systems comprising two parallel cartridges and one dynamic mixing head are known, for example from EP-B-313519 and EP-B-351358. DE-A-4202591 describes a method for premixing at least two pastes on introduction into a mixer, in which the strands of paste delivered to the mixer form thin adjacent layers. One feature common to all these two-component systems is that special applicators are required for their application.

It is known that two fluid media/components can be combined, for example, by specially designed devices comprising two adjacent cylindrical chambers filled with different fluid media. These chambers open into a common outlet opening onto which a suitable mixer, for example a static mixer, can be fitted. The two media to be combined are expressed from the cylindrical chambers of the device under pressure by plungers and emerge from the outlet opening in the form of a single strand formed by the combined media. The strand then enters the following mixer in which it is mixed to form a uniform final medium before emerging from the outlet opening of the mixer for application.

Containers filled with special dental care formulations are also known, being filled with at least two different, flowable and optically different dental care components. Through the design of the container, dental components stored one above the other in the container leave the outlet opening in the form of a single strand in which the dental care components in contact with one another lie beside one another forming stripes.

These known devices have the disadvantage that they are specially designed for particular applications and can only be used for those applications. In addition, the fluid media are introduced into the storage chambers by the manufacturer, the range of application of the media being determined in advance by their composition. As a result, the user is unable to influence, determine or modify the working medium in situ or during work. For example, the color of the material cannot be changed which is a disadvantage in particular when the color of a two-component adhesive or a sealing compound, for example, is to be matched with the color of the parts to be bonded or sealed.

Other known devices comprise chambers into which the media to be mixed are introduced and mechanically mixed and subsequently discharged in the form of a mixed strand. One such device is described, for example, in DE 92 18 334 U1. However, devices of this type have the disadvantage that the entire supply of a first fluid medium has to be mixed with the second fluid medium or other fluid media before application can be commenced. Accordingly, the mixture cannot be subsequently influenced and has to be applied in the composition initially selected. In addition, the mutual influencing of the components is initiated by mixing so that, for example in cases where the physical properties of the components are altered by their combination, application has to be completed within a correspondingly predetermined time because it may no longer be possible thereafter. Another disadvantage of devices of the type in question is that the individual process steps have to be completed in the correct sequence which is both time consuming and inefficient and which makes it virtually impossible to mix fast-reacting components.

The technical problem addressed by the present invention was to provide a device and a method for combining at least two fluid media which would enable at least two fluid components or fluid media influencing one another to be kept separate from one another until immediately before application and to be continuously combined and optionally mixed immediately before application, the ratios between the various components being determined in advance but capable of variation.

SUMMARY OF THE INVENTION

According to the invention, the solution to this technical problem is characterized in that, in a device of the type mentioned at the beginning, at least a second chamber designed to be filled with a second fluid medium is provided and comprises at least one first opening element, by which it is connected to the flow region and/or to the first opening, and at least one second opening element, by which it is connected to the flow region and/or to the outlet opening, and by a method of the type mentioned at the beginning, in which, the effect of the energy with which a fluid medium is expressed from its storage container is that at least one second fluid medium is expressed from its storage container and combined with the first fluid medium.

The method and device according to the invention have the advantage that the disadvantages known from the prior art are avoided. They enable at least one fluid medium for the particular application to be freely selected by the user so that the composition of the product consisting of at least two fluid media can be influenced in situ by the user. Auxiliary devices at least partly available on the market, such as cartridges, spray guns and static mixers, may be used for this purpose. The device enables the media to be combined immediately before application, the media being continuously transported and only relatively small quantities of already combined and mixed media being present in the system.

If, in a device according to the invention, the first opening element is arranged adjacent the front part of the flow region in the direction of flow and if the second opening element is arranged adjacent the rear part of the flow region in the direction of flow, the transport paths for the second fluid medium can advantageously be kept short. If, in another embodiment, the second fluid medium is transported from the second opening element into the front part of the flow region through a channel, the flow region itself is advantageously available for mixing the medium.

In one particular embodiment, the upper part and lower part of the housing are delimited in such a way that only parts of the upper part are in contact with mixed fluid media. This ensures that, if at least one of the fluid media has not been fully used or if application is interrupted, the upper part of the housing can be removed from the lower part and the media remaining in the lower part are unmixed. The upper part may then be replaced after brief interruptions or a completely new upper part may be fitted in order to continue application with the fluid media still present. Separating elements may advantageously be provided on the upper part, projecting into the lower part and taking away mixed media on removal.

Taking the flow properties of the media into account, the flow cross-sections are best dimensioned in such a way that the fluid media issue in quantities corresponding to the required mixing ratio.

In another advantageous embodiment, the flow cross-sections for at least one of the unmixed fluid media are adjustable. In this way, it is possible either to vary the mixing ratio between the fluid media with the same device or, alternatively, to establish the required mixing ratio where the flow properties change as a function of temperature.

Examples of elements with which the flow cross-sections can be adjusted are replaceable inserts with different cross-sections, preferably externally operable rotary diaphragms or channels telescopically slidable into one another which form different cross-sections either through a conical shape or through slots.

If the outlets of the unmixed fluid media are provided with a shut-off element which automatically closes the outlet on removal of the upper part, dripping of the fluid media is advantageously avoided. A spring element arranged at the outlet of the second chamber, which is designed to open under the flow pressure of the second fluid medium, advantageously prevents dripping in the event of interruptions in application as soon as the pressure built up in the second fluid medium under the effect of the first fluid medium has fallen to such an extent that it is smaller than the restoring force of the spring element. This spring element may be provided alternatively or in addition to the above-mentioned shut-off element for the outlet.

The double-walled construction of the housing provides for effective thermal insulation. However, an insulating effect against other influences, such as diffusing gases or radiation, can also be obtained by other means, for example by coating. Arranging siccatives in the housing in such a way that they are in contact with at least one fluid medium ensures effective protection against moisture-induced influencing of the fluid media. By making the outer wall at least partly transparent in the vicinity of the chamber, it is advantageously possible visually to monitor the filling level of the second fluid medium.

The fact that the outlets for unmixed fluid media can be closed, for example by plugs, adhesive tape or covers, enables the fluid media introduced into the device to be additionally protected against environmental influences before application or in the event of interruptions in application involving separation of the upper and lower parts of the housing. The provision of a spiral static mixer in the mixing zone of the upper part of the housing advantageously establishes the conditions for effective mixing of the combined fluid media. If a channel utilizing most of the available area is spirally formed in the mixing zone, a long mixing path is obtained.

To solve the technical problem addressed by the present invention, a method of combining at least two separately stored fluid media is proposed in which the effect of the energy with which a fluid medium is expressed from its storage container is that at least one second fluid medium is expressed from its storage container and combined with the first fluid medium. Using this method, it is possible with advantage to utilize the energy expended in expressing the first fluid medium from its storage container, for example a cartridge, to express at least one second fluid medium from its storage container. The energy present in the transport strand of the first fluid medium can bring this about by diverting part of the strand so that it exerts a pressure on the second fluid medium and displaces it from its storage container. However, the energy may also be used to transport the at least second fluid medium by guiding the strand of the first fluid medium through a nozzle-like part of the device, for example a venturi-like part of the flow region, the reduced pressure in the vicinity of the nozzle creating a suction effect which acts on the second fluid medium in such a way it is expressed from its storage container. The pressure or reduced pressure may be controlled in such a way that the second fluid medium, is delivered in a predetermined volume in relation to the volume of the first fluid medium.

Examples of first fluid media are adhesives and/or sealants as the basic component. Examples of second or more than second fluid media are catalysts, colouring components and crosslinking agents. It is even possible to use more than one of these substances for this purpose.

The device according to the invention is advantageously an adapter which is fitted onto a cartridge, preferably a commercially available cartridge. This adapter may be filled with a small quantity of a catalyst and/or crosslinking and/or colouring component and is shaped in such a way that the stream of basic component (adhesive/sealant) expressed from the cartridge is continuously mixed with the catalyst and/or crosslinking and/or colouring component and the resulting mixture is uniformly discharged through a nozzle optionally screwed on before the adapter. Mixing of the two components may optionally be completed by a static mixer fitted onto the adapter. Although basically any type of two-component adhesive/sealant, in which the second component may be used in a small quantity, is suitable for the method according to the invention, a one-component moisture-curing system is used as the basic component in particularly preferred embodiments. This basic system may be based, for example, on polyurethane adhesives/sealants containing reactive isocyanate groups, although the basic adhesive/sealant may also be based on polydimethyl siloxanes, alkoxysilane-terminated polyethers or on polymers containing reactive epoxide groups. One example of a particularly suitable polyurethane adhesive/sealant is described, for example, in the Example 3 of WO 95/00572. Suitable adhesives/sealants based on alkoxysilane-terminated polyethers are described in detail in DE-C-4119484, the fluoride surfactants described therein not necessarily having to be part of the adhesives/sealants to be used in accordance with the present invention.

The catalyst component is determined by the basic adhesive/sealant used. For polyurethanes, the catalyst component may be any of the organometallic compounds known in polyurethane chemistry, for example iron or tin compounds. Examples of suitable catalysts are 1,3-dicarbonyl compounds of iron or divalent or tetravalent tin, but especially tin(II) carboxylates and dialkyl tin(IV) dicarboxylates, and the corresponding dialkoxylates, for example dibutyl tin dilaurate, dibutyl tin diacetate, dibutyl tin dibutylate, dioctyl tin diacetate, dibutyl tin maleate, tin(II) octoate. The highly effective tertiary amines or amidines may also be used as catalysts, optionally in combination with the tin compounds mentioned above. Suitable amines are both acyclic and, in particular, cyclic compounds, for example tetramethyl butane diamine, bis-(dimeth-ylaminoethyl)-ether, 1,4-diazabicyclooctane (DABCO), 18-diazabicyclo-(54.0)-undecene, 2,2'-dimopholinodiethyi ether or dimethyl piperazine or even mixtures of the above-mentioned amines.

If the basic adhesive/sealant formulation is based on alkoxysilane—terminated polyethers, the tin compounds mentioned above may be used although long-chain aliphatic amines are preferably used as amine catalysts.

Suitable crosslinking components are organic diamines or triamines, for example ethylenediamine, propylenediamine, 1,4-diaminobutane, diethylenetriamine or piperazine, and optionally even low molecular weight aminoterminated polyethers of the "Jeffamin" type. Suitable polyol crosslinking agents are basically any of the polyols known from polyurethane chemistry, more especially low molecular weight polyether diols and triols, polyester polyols, polyols based on e-caprolactone and also known as "polycaprolactones." However, polyester polyols of oleochemical origin are also particularly preferred. Oleochemical polyester polyols may be obtained, for example, by complete ring opening of epoxidized triglycerides of a fatty acid mixture containing at least partly olefinically unsaturated fatty acids with one or more $C_{1-12}$ alcohols and subsequent partial transesterification of the triglyceride derivatives to alkyl ester polyols containing 1 to 12 carbon atoms in the alkyl group (see, for example, DE-A-3626223). Other suitable polyols are polycarbonate polyols and dimer diols (Henkel KGaA) and, in particular, castor oil and its derivatives.

Suitable crosslinking components for alkoxysilane-terminated polyether systems and for adhesives/sealants based on polydimethyl siloxanes are any of the low molecular weight silane crosslinking agents known in silane chemistry.

The diamines or polyamines mentioned above may be used for adhesives/sealants based on polymers containing reactive epoxide groups.

Although liquid crosslinking agents and catalysts may be directly used, it may be advisable to add inert solvents and/or plasticizers to them and optionally to match the viscosity of these solutions with thickeners to the viscosity of the basic adhesive/sealant.

In another embodiment of the invention, a colouring component may be added through the adapter. This simplifies storage for the user insofar as he only has to store a single adhesive/sealant in one basic colour (for example colourless or white-pigmented) and can adapt the colouring component to suit his requirements. In vehicle construction, for example, it may be the lacquer used for the vehicle.

The catalyst and/or crosslinking component and the colouring component may also be combined in a single paste.

As mentioned above, the catalyst, crosslinking and/or colouring component is used in a small quantity in relation to the basic component, so that a low-volume adapter is sufficient. This component is preferably added in a quantity of 0.5 to 8% by weight, based on the basic component.

The invention is illustrated by the following Example.

EXAMPLE

The adapter according to the invention was screwed onto the cartridge of a commercially available one-component moisture-curing polyurethane adhesive/sealant (Terostat 8597, Teroson GmbH). 2% by weight of castor oil were then introduced into the adapter. Using a commercially available cartridge gun, the mixture of adhesive/sealant and crosslinking agent was applied to aluminum "angles". These aluminum angles had been coated with a polyurethane primer (Terostat 8510, Teroson GmbH) and aired for 15 minutes. The aluminum angles were fitted together in such a way that a 5 mm thick glueline was formed. 45 Minutes after the angles had been fitted together, the bond was tested for tensile strength. A tensile strength of 0.6 $N/mm^2$ was measured. Separation of the primer from the substrate was observed because the primer had not developed its full strength. It may be assumed that a higher tensile strength would otherwise have been measured.

In a comparison test, the adhesive/sealant was similarly applied to aluminum angles without using the crosslinking agent or adapter and was tested for tensile strength. After 45 minutes, a tensile strength of 0.15 $N/mm^2$ was measured.

Embodiments of the device according to the invention are illustrated in the accompanying drawings. The already mentioned advantages and other advantages of the present invention will become clear from the following description of these embodiments. In the drawings, which are all sectional side elevations except for FIGS. 6, 13, 14 and 17,

DETAILED DESCRIPTION OF THE INVENTION

Figure 1:
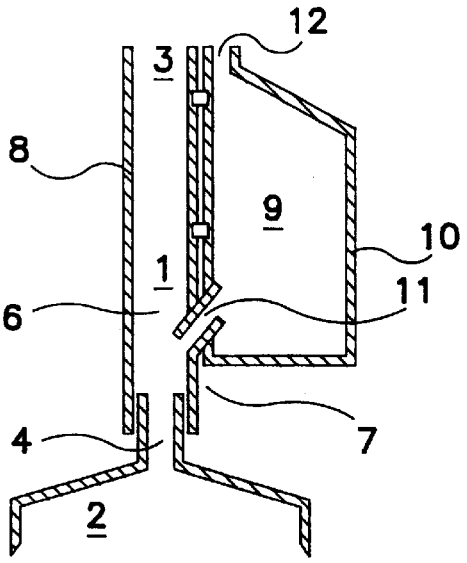
FIG. 1 is a diagrammatic illustration of one embodiment of the device according to the invention with a second chamber arranged on one side.

FIG. 1 shows one embodiment of a device according to the invention for combining at least two fluid media. The flow region 1 for the first medium issuing from the first chamber 2 formed in particular by a cartridge-like or tube-like container begins with the opening 4 of the first chamber and extends via a flow region 1—in the form of a channel element 6 attached to the opening 4 of the first chamber at its inlet zone 7—as far as the outlet opening 3 and is defined by channel-like walls, such as the wall of the opening 4 of the first chamber and the wall 8 of the channel element. Accordingly, coming from the first chamber 2, the first medium is accommodated in the correspondingly designed flow region 1 and flows through it to the outlet opening 3. Adjacent the flow region 1 and the channel element 6 is a second chamber 9 with a wall 10. The second chamber 9 and the flow region 1 of the channel element 6 are connected by at least one diversion opening 11, preferably arranged on the first chamber side, for diverting part of the first medium into the second chamber 9 which is provided with at least one second opening 12 to allow the second medium to flow out. The second opening 12 is located beside the outlet opening 3 of the channel element 6 or the flow region 1. It may extend over the entire circumference of the wall 8 of the channel element or may be arranged in only a limited zone adjacent the wall 8.

The first chamber 2 and the channel element 6 are mutually arranged, for example, in the vicinity of the inlet 7 of the channel element and the opening 4 of the first chamber by suitable fixing means (not shown), for example screws. However, the fixing means are by no means confined to screws. Instead, other suitable fixing elements may be used, including in particular clips, snap-action fastenings, plug-type fastenings or bayonet-type fastenings or a combination of at least two of these elements/fastenings or parts thereof. The fastenings may be releasable or fixed.

By means of a displaceable piston or by compressing the first chamber 2, the user expresses the first medium from the first chamber 2 through the flow region 1 beginning with the opening 4 of the first chamber into the channel element 6 through which it passes and which it leaves again at the outlet opening 3 of the flow region. Part of the first medium is diverted into the second chamber 9 through the diversion opening 11 and displaces the second medium which is present in the second chamber 9 and which leaves the second chamber 9 through the second opening 12 located beside the outlet opening 3, so that the first medium and second medium are combined at this point. The second chamber 9 is filled with a second medium through the second opening 12. The channel element 6 and the second chamber 9 may comprise several moulded parts. For example, the channel element 6 may comprise optionally flexible tube- or hose-like part while the second chamber 9 may comprise, for example, of a plastic or metal part. The first chamber 2 and the channel element 6 are joined together by suitable fastenings means. The diversion opening or rather the first opening element 11 may be in the form of a small tube or similar hollow moulding. Accordingly, the first chamber, the opening of the first chamber, the flow region or the channel element, the second chamber, the diversion opening(s) and the second opening(s) form a functional unit. In order to express the first medium from stable first chambers consisting, for example, of metal cartridges, the user may employ existing commercially available auxiliary means, for example in the form of plungers, etc. Where the first comprises plastic tubes, the first medium may be manually expressed.

In another embodiment, the device may be provided with several second chambers each connected to the flow region or rather to the channel element by at least one branching element/diversion opening. According to the invention, the effect of the measures described above and in connection with the other described embodiments of the device is that, through the delivery of the first medium through the flow region, a second medium is automatically added to the first medium, the corresponding drive energy for the second medium being supplied by a diverted or branched part of the first medium itself.

Figure 2:
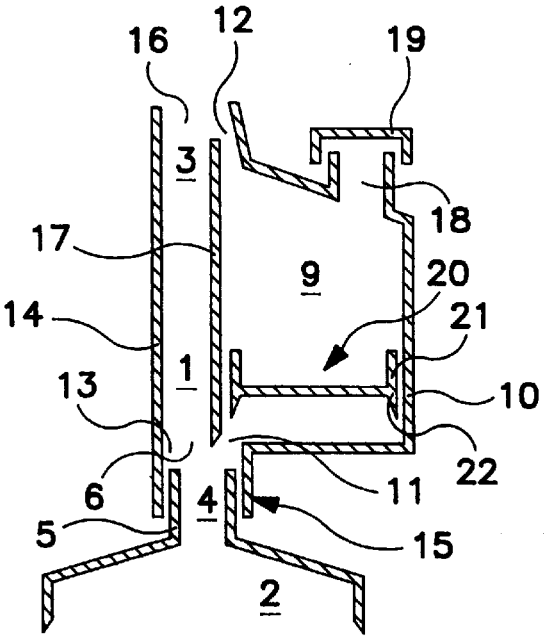
FIG. 2 is a diagrammatic illustration of an embodiment of the invention similar to that illustrated in FIG. 1, but with a separating element and a closable feed zone in the second chamber.

FIG. 2 shows a simplified embodiment of the device for combining at least two fluid media comprising a housing 14 in which the channel element 6 (as a flow region 1 in the housing 14) and the second chamber 9 are integrated. The housing 14 has an inlet opening 15 for the first medium from first chamber 2 which is equivalent to the inlet opening 7 of the flow region 1 on the housing side or rather the channel element 6 of FIG. 1. As in FIG. 1, the outlet opening 16 of the housing 14 is equivalent to the outlet opening 3 of the flow region or rather the channel element 6.

Located in the housing 14 is a partition 17 which divides the housing 14 into the second chamber 9 intended for the second medium and the flow region 1 intended for the first medium and combines the functions of the wall 8 of the channel element and the wall 10 of the second chamber of FIG. 1. On the housing entrance side, it extends like a projection into the flow region 1 of the first medium and, on actuation of the device, diverts part of the first medium, through the diversion opening 11 into the second chamber 9.

The second opening 12 opens into the flow region 1 in front of the outlet opening 3, so that the first medium and the second medium are combined at this point. The housing 14 is provided with a separate feed zone 18 for the second medium which, after introduction of the second medium into the second chamber 9, is sealingly closed by means of a closure element 19 so that, when the device is actuated, no second medium is able to escape from the second chamber 9 through the feed zone 18 of the housing 14.

The second chamber 9 contains a displaceable separating element 20 which separates the first medium from the second medium and which is driven towards the second opening 12 by the first medium entering the second chamber 9, expressing the second medium from the second chamber 9 through the second opening 12. The separating element 20 is in the form of a rigid part and, when it is driven forward, is guided by the wall 10 of the second chamber and the partition 17. However, it is preferably provided with guide section(s) 21 in the vicinity of the wall 10 and/or the partition 17. In addition, it is preferably provided on its side facing the first medium with pressure distributing element(s) 22 which distribute the pressure exerted by the first medium on the separating element 20 to build up a uniformly acting driving force. This additional measure is intended to prevent the separating element 20 from tilting at the partition 17 and/or the wall 10 of the second chamber. The fluid media combined at the outlet 16 of the housing or rather the outlet 3 of the channel element issue from the outlet opening adjacent one another in the form of a strand for example in the case of two highly viscous fluid media or at least one highly viscous fluid medium. Accordingly, this embodiment of the device provided with a separating element is particularly suitable for cases where direct contact between the first medium and second medium before they are intentionally combined is to be avoided and, for example, their premature mixing and/or unwanted chemical reaction is to be prevented.

Figure 3:
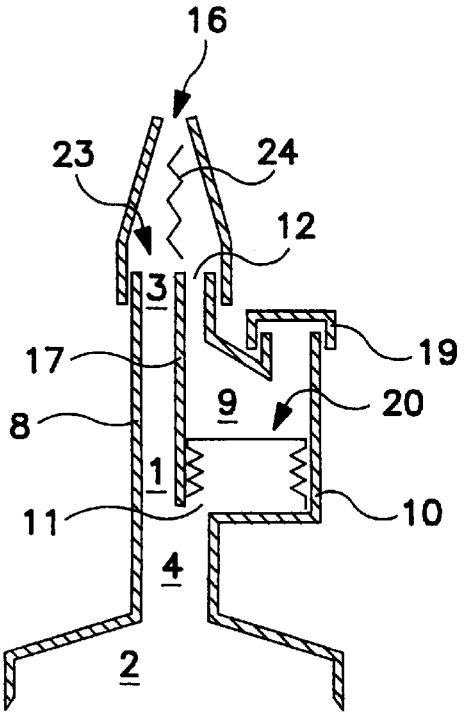
FIG. 3 is a diagrammatic illustration of an embodiment of the invention with a flexible, elastic separating element in the second chamber and an attached mixing zone and static mixer.

FIG. 3 shows another embodiment of the device according to the invention, again in section. In this embodiment, the first chamber 2 and the second chamber 9 are fitted together in one piece, so that the opening 4 of the first chamber and the entrance of the channel element or rather the entrance of the flow region 1 on the housing side merge with one another. As in FIG. 2, the partition 17, which is also part of the wall 8 of the channel element and the wall 10 of the second chamber, is directed like a projection into the flow region 1 intended for the first medium and constricts it. The second opening 12 is located beside the outlet opening 3 of the housing, so that the first medium does not come into contact with the second medium up to that point.

The separating element 20 located in the second chamber 9 is in the form of a folded film and is unfolded or expanded by the first medium entering the second chamber 9 through the diversion opening 11, thus displacing the second medium which then leaves the second chamber 9 again through the second opening 12. Instead of a separating element consisting of film-like material, rubber-like, latex-like or other elastic parts/materials may be used for the separating element or for parts thereof. Tube-like or film-like packs filled with the second medium, which are introduced into the second chamber, may also be used. This type of pack then forms the foldable or elastic separating element.

An additional mixing zone 23 is arranged on the housing 14 by suitable fastening means (not shown), for example screws, clips, snap-action fastenings, plug-type fastenings, bayonet-type fastenings or a combination of at least two of these elements/fastenings or parts thereof. In this additional mixing zone 23, the first medium and second medium are further combined by a turbulence element 24 positioned therein in such a way that they are completely mixed together.

The mixing zone 23 extends the flow region 1 of which the outlet opening 16 is also the discharge opening of the mixing zone 23. Attachable mixing zones as additional mixing elements are known in the form of so-called static mixers and, as such, do not form any part of the present invention. For example, they may assume the form of a tube in which a turbulence element is arranged. However, if known mixing zone/mixing elements are attached to the device according to the invention, they form part of the device according to the invention. A housing construction such as this is advisable in particular in cases where, for example, the two fluid media are to be prevented from chemically reacting in the absence of a following mixing zone. Accordingly, the device or rather its mixing zone 23 after partial use can be separated from the housing by releasable fastenings, put to one side and subsequently used as required, optionally provided with a new mixing zone.

Figure 4:
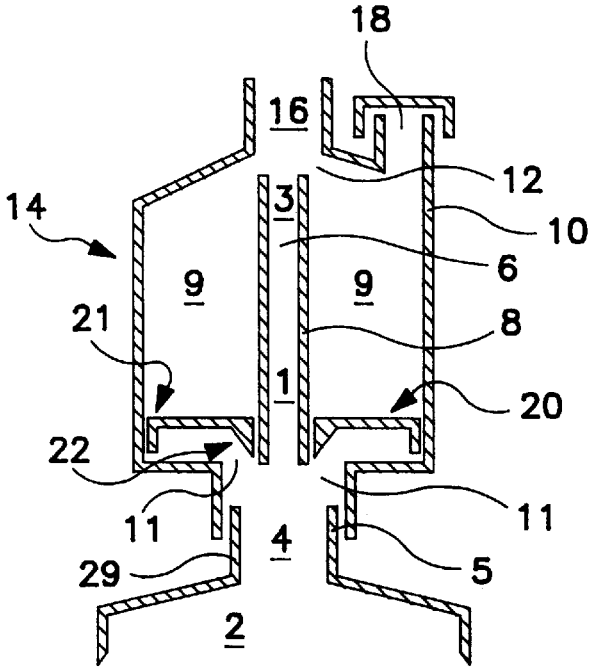
FIG. 4 is a diagrammatic illustration of an embodiment of the device according to the invention with a second chamber arranged annularly around a central flow region.

FIG. 4 is a section through another embodiment of the device of the invention comprising a housing 14 preferably round in shape and a first chamber 2—also preferably round in shape—fitted to the housing 14. The flow region 1 on the housing side is in the form of a channel element 6—aligned centrally in relation to the opening 4 of the first chamber—with a wall 8 which is also preferably round and which, at the housing entrance, extends like a projection into the flow region 1 of the first medium, preferably in section(s) only, and thus constricts the flow region 1. Arranged in the intermediate zone produced between the wall 8 of the channel element and the wall 5 of the first chamber or rather the wall 29 of the housing entrance are, for example, two diversion openings 11 through which part of the first medium passes onto the separating element 20 arranged annularly around the wall 8 of the channel element, drives it forward and thus displaces the second medium from the second chamber 9 again through the second opening 12.

Embodiments of the device where the channel element or rather its wall(s) extend(s) into the opening of the first chamber are also possible. The diversion opening(s) may also be arranged in or on the opening of the first chamber itself.

The first medium passes through the channel element 6 to the outlet opening 3, the second opening(s) 12 opening into the flow region in front of the outlet opening 3, so that the two fluid media are combined before the outlet opening 3 and, where at least one of the two fluid media is highly viscous, leave the housing 14 again through the outlet opening 3,16 in the form of a single strand. Depending on the size and number of second openings in the wall 8 of the channel element or rather the chamber wall 10, one or more regions filled by the second medium are formed where the fluid media are combined, for example, with at least one highly viscous first medium. If, for example, two diametrically arranged second openings are provided for the second medium, the strand of the first medium is provided with two likewise diametrically opposite segments of the second medium, at least in the region where the two fluid media are combined with one another, the size of these segments being determined by the size of the second openings.

Instead of being round, the housing may also be provided with walls arranged at an angle to one another. In this case, the separating element may be annularly arranged around an angled or round channel element wall or separating wall.

Accordingly, those parts of a rigid separating element facing the wall of the second chamber are also angled. If several second media are to be added to the first medium, the housing may comprise several second chambers which respectively contain or are filled with the various media. Thus, where the housing is round in shape, the second chamber may be divided by corresponding radially arranged intermediate walls into several sector-like sub-chambers in each of which, for example, a separating element with correspondingly sector-like sections is arranged. It is obvious that a feed zone for the second medium, at least one diversion opening for the inflowing first medium and at least one second outlet opening for the second medium are associated with each second chamber.

Figure 5:
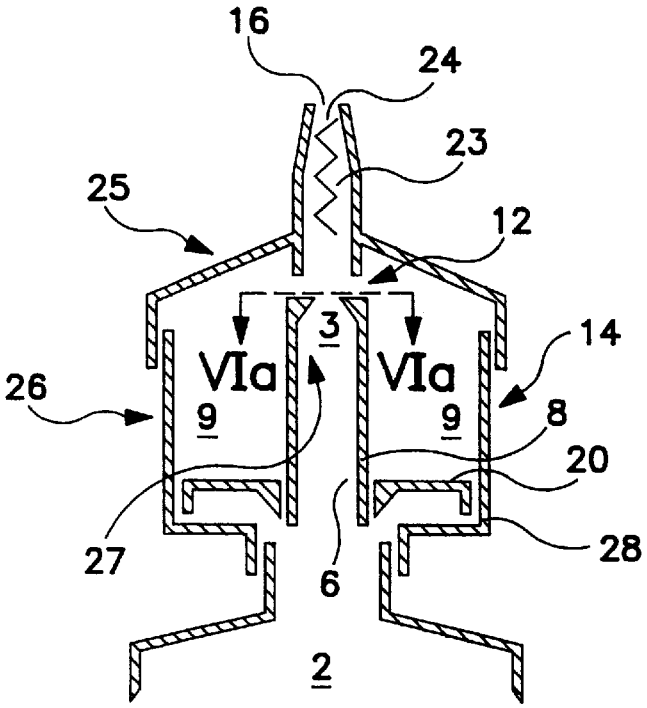
FIG. 5 is a diagrammatic illustration of an embodiment of the invention in which the housing is separated into an upper part and a lower part.

FIG. 5 is a section through a particularly preferred embodiment of the device according to the invention in which the separating element 20 is again arranged annularly around the channel element 6. In this embodiment, the housing 14 consists of an upper part 25 and a lower part 26 which are designed to be fitted together by suitable fastenings (not shown), for example screws, clips, snap-action fastenings, plug-type fastenings, bayonet fastenings or a combination of at least two of these elements/fastenings or parts thereof. The flow region extends from the first chamber 2 to the outlet opening 16 which is formed in the upper part 25 of the housing and which is preceded by a mixing zone 23. In the embodiment in question, the mixing zone 23 is provided with a turbulence element 24 lying in the flow region and is a fixed part of the upper part 25 of the housing. Before the second opening 12, the flow region 1 on the housing side with the wall 8 of the channel element has one or more wall projections 27 directed into the flow region 1 of the first medium. When the upper part 25 of the housing is removed from the lower part 26, the user introduces the second medium into the housing 14 thus opened, i e. into the open annular second chamber 9 of which the feed zone 18 is positioned between the wall 8 of the channel element and the outer wall 28 or the housing, and then closes the housing by replacing the upper part 25 which also forms a sealing closure element for the second chamber 9. Accordingly, the outer wall 28 of the housing also acts as part of the wall of the second chamber. If the housing is to comprise several second chambers, these second chambers and also their feed zones are formed by the outer wall 28 of the housing, by intermediate walls directed radially of the wall 8 of the channel element and by the wall 8 of the channel element. Each individual second chamber is also preferably closed by the upper part of the housing. However, the second chambers may also be closed by a separate closure element or by an additional closure element formed in piece for all the second chambers, the upper part of the housing then being placed with its outlet opening on the lower part.

Before the second opening, the strand of a preferably viscous or paste-like first medium transported through the flow region passes onto the projections 27 of the channel element wall 8 directed into the flow region 1 of the first medium and is provided there with corresponding recesses directly centrally into the flow region 1. These recesses create space for the introduction of the second medium which, passing through the second opening 12 to the first medium, does not have first to displace part of the first medium. The second opening(s) 12 are formed by corresponding design measures between the upper part 25 and lower part 26 of the housing. However, they may also be located in parts of the upper part 25 of the housing. The second medium driven forward by the separating element 20 in the second chamber 9 is delivered through the second opening(s) 12 to the first medium provided with recesses formed by projections 27 and is combined with the first medium in the following mixing zone 23 with further constriction and crosslinking. It may then be applied from the outlet opening 16 in the upper part 25 of the housing. The housing of the device is preferably designed in such a way that its width or its external diameter is equal to or smaller than the external cross-section or external diameter of the first chamber or its outer wall, so that the housing does not interfere with the user's view necessary for cleanly placing the combined fluid media.

Figure 6A:
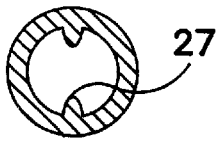
FIG. 6*a* is a plan view on the line VIa—VIa of FIG. 5.

FIG. 6*a*, which is a sectional plan view of the channel element 7 before the second opening 12, shows the projections 27 of the channel element wall 8 directed centrally into the flow region 1.

Figure 6B:
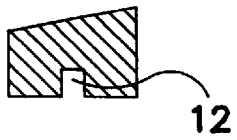
FIG. 6*b* is a side elevation of a wall element of FIG. 5 with the second opening 12.

FIG. 6*b* shows that part of the flow region 1 which follows the projections 27 of the channel element wall 8 and which is provided with the second opening(s) 12.

Figure 7:
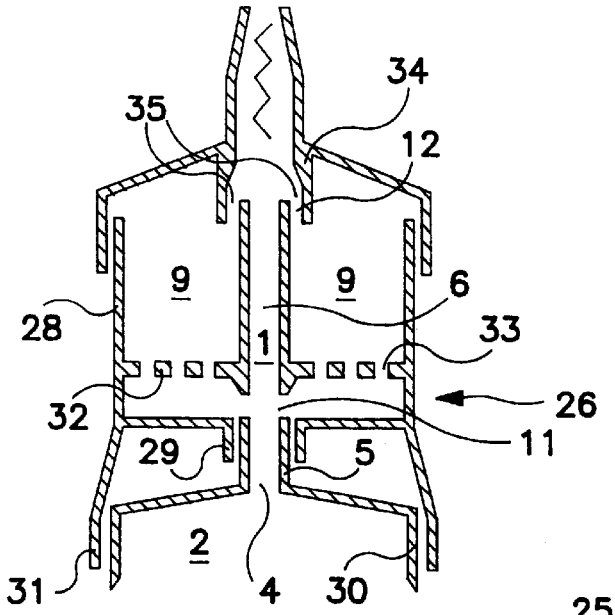
FIG. 7 is a diagrammatic illustration of an embodiment of the device according to the invention with a perforated distributor element in the second chamber.

FIG. 7 is a section through a device for combining at least two fluid media. In this case, the lower part 26 of the housing is arranged on the first chamber 2 via corresponding fastenings 13 (not shown) in conjunction with attachment sections 31 which are located on the outer wall 28 of the lower part 26 of the housing and which extend over the outer wall 30 of the first chamber 2. The housing entrance, which is entrance 29 of the channel element 6 of the flow region 1 on the housing side, is attached to the opening 4 of the first chamber. Instead of a separating element arranged for movement in the second chamber 9, a fixed distributor element 32 is located above the diversion opening(s) 11. The distributor element 32 is preferably plate-like and provided with perforation(s) 33 which are intended to ensure uniform application of the first medium to that side of the distributor element 32 which faces the second medium. The number and shape of the perforation(s) 33 and the shape of the distributor element 32, for example concave or convex, may therefore be different. The distributor element 32 may be additionally provided on its side facing the second medium with a separating element where premature contact between the two fluid media is to be avoided and/or the uniform displacement of the second medium from the second chamber is to be improved.

The diversion openings 11 are located in a parallel flow region 1 formed by the wall 5 of the opening of the first chamber and the wall 8 of the channel element, the wall 29 of the housing entrance being attached to the first chamber via the wall 5 of the opening of the first chamber. When the device is actuated, a counter-pressure is produced in the flow region 1 of the first medium under the effect of the mixing zone 23 arranged on the housing side in the channel element 6, causing part of the first medium to flow out through the diversion opening(s) 11 into the second chamber 9. The creation of the counterpressure is not dependent upon a mixing zone following the diversion opening(s). It may also be additionally or alternatively generated by constricting the flow region between the diversion opening and the outlet opening in any way, for example by narrowing the diameter/cross-section of the channel region or by other design measures, for example the projections 27 on the wall 8 of the channel element as shown in reference to FIGS. 5 and 6*a*. The upper part 25 of the housing is provided with a tube 34 which surrounds the wall 8 of the channel element located in the lower part 26 of the housing and which, is locally provided with one or more recess(es) 35 which form the second opening(s) 12. However, the second openings 12 may also or additionally be formed by recesses in the wall 8 of the channel element.

Figure 8:
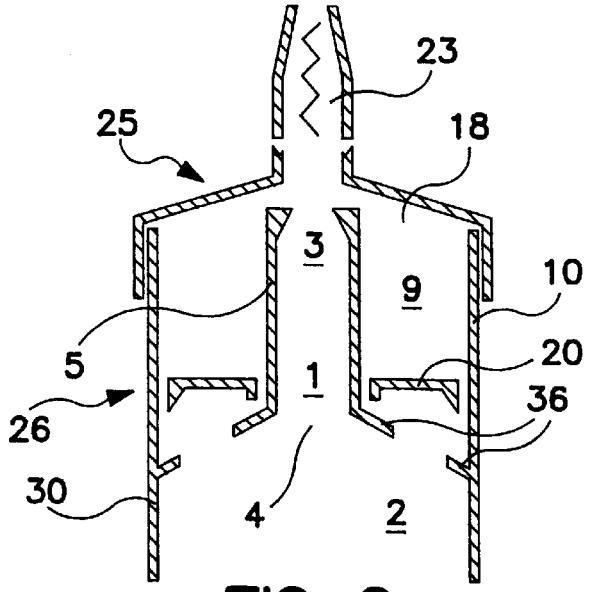
FIG. 8 is a diagrammatic illustration of an embodiment of the invention in which the lower part of the housing is integrated in the first chamber.

According to the various observations in the foregoing on the device for combining at least two fluid media, the diversion and/or second opening(s) may assume various forms. Thus, the ratio of first medium to second medium is defined, for example, according to the size and shape of the diversion and/or second opening(s) in relation to the cross-section of the channel. At least partly radial opening(s) are preferably provided to ensure uniform flow behaviour of the particular fluid medium. In addition, the opening(s), for example in the wall of the channel element or rather the flow region, may be accompanied by constriction(s) and/or widening(s) of the cross-section. For example, they may assume the form of step-like and/or projection-like diversion zones(s) and/or oblique openings for the particular fluid medium to promote or facilitate entry of the media into the intended regions. The second opening(s) may also be formed by corresponding design measures between elements of the upper part of the housing and the channel element located in the lower part of the housing or its walls. The flow region with the walls of the channel element may be part of the upper part and/or lower part of the housing or may assume the form of a separate moulding fitted into the housing. The opening region of the first chamber may also form at least part of the flow region on the housing side or the channel element, as shown in FIG. 8 and in FIG. 9. The invention encompasses all possible forms of embodiment of the flow region and the diversion and second opening(s) providing the first medium is branched as required into the at least one second chamber and the at least one second medium issues from the at least one second chamber.

In FIG. 8, the lower part 26 of the housing and the first chamber 2 are integral with one another, the outer wall 30 of the first chamber 2 extending beyond the first chamber 2 and forming the outer wall 28 of the lower part 26 of the housing or part of the wall 8 of the second chamber. The diversion opening(s) 11 are located in the intermediate wall 36 connecting the wall 5 of the opening of the first chamber to the outer wall 30 of the first chamber, so that the first medium passes directly from the first chamber 2 through the intermediate wall 36 into the second chamber 9 where it drives the second medium forward directly or indirectly through a separating element(s) 20. The opening 4 of the first chamber extends with its wall 5 into the housing 14 where it at least partly forms the flow region 1. The second opening(s) 12 through which the second medium issues from the second chamber 9 are formed by design measures between parts of the upper part 25 of the housing and the wall 5 of the opening of the first chamber which also comprises the wall of the channel element, part of the wall 10 of the second chamber and the partition. However, they may also be located in the wall 5 of the opening of the first chamber or solely in elements of the upper part of the housing. The outlet opening 3 of the flow region 1 is located at the housing exit or, where a mixing region 23 is attached, at the discharge opening thereof.

Figure 9:
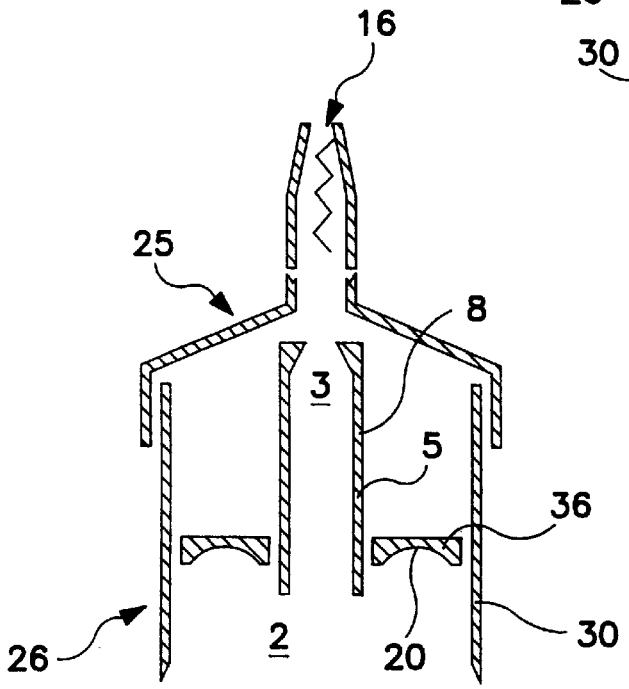
FIG. 9 is a diagrammatic illustration of an embodiment of the invention in which the lower part of the housing is integrated in the first chamber.

FIG. 9 shows another embodiment of the device according to the invention for combining at least two fluid media. In this embodiment also, the lower part 26 of the housing and the first chamber 2 are integral with one another. The lower part is closed by an upper part 25 having an outlet opening 16. The rigid intermediate wall located between the wall 5 of the opening of the first chamber and the outer wall 30 has been omitted, so that the separating element 20 acts as a displaceable intermediate wall 36. The position of the diversion opening for the first medium is thus variable and, corresponding to the particular position of the displaceable intermediate wall 36 or the separating element 20 in the form of a displaceable intermediate wall, is located on its side facing the first medium between the wall 5 of the opening of the first chamber and the outer wall 30 of the first chamber.

In a modification of the embodiment illustrated in FIG. 9, support sections are provided at the boundary between the first chamber and the second chamber. By means of these support sections, the displaceable intermediate wall 36 or rather the separating element 20 can be accurately positioned before the first and/or second chambers are filled so that the volume of the first and second chambers is accurately determined in advance. The device may also be modified in such a way that diversion openings are located both in the flow region provided for the first medium and in the area between the opening of the first chamber and the outer wall of the first chamber.

Another possible embodiment of the device is characterized by several housings in a cascade-like arrangement, the fluid medium issuing from the first flow region, which consists of at least two combined fluid media, forming the first medium for the following flow region. Accordingly, the outlet opening of the first flow region opens into the following flow region to which the second medium issuing from an at least one correspondingly positioned second chamber is delivered. This type of device for combining at least two fluid media is advisable for cases where the at least first two combined fluid media are intended to combine or react with one another before another fluid medium is added. The device according to the invention may be operated until the second chamber accommodating the second medium is filled with the first medium, the second medium having been completely or partly displaced from the second chamber, or until the first medium transported from the first chamber through the flow region and partly diverted into the at least one second chamber has been expressed from the first chamber. The housing may then be cleaned to remove first medium and any residues of the second medium still present, refilled with the second medium and reused. In a particularly preferred embodiment, however, the device according to the invention is made as a disposable article, preferably from plastics, and is discarded after use. This eliminates the need for expensive cleaning using possibly environmentally unsafe chemicals/solvents, etc. According to the potential applications mentioned below, a housing made of plastic for use in the home can be used as often as required after cleaning. The variants of the device with a housing shown in FIGS. 2 to 7 are suitable for this purpose and as disposable articles.

The device according to the invention has various applications. Thus, in the home for example, paste-like fluid media may be decoratively combined, optionally in a stripe pattern, with second fluid media, for example cream with liquid chocolate. In the technical sector for example, the two components of a two-component adhesive may optionally be combined with a third colouring component. Sealants or adhesives may also be coloured, so that the seed or bond between two objects can be colour-matched with those objects. Another advantage of the device according to the invention is that expensive, for example laminate-like, packs for fluid media, which would react as such and/or with their natural surroundings through the pack, can be reduced in their composition. This saves costs in the packaging sector and/or preserves natural raw material resources because the at least one second component is only added to the first component before application and, accordingly, only forms the medium to be applied at that moment.

Figure 10:
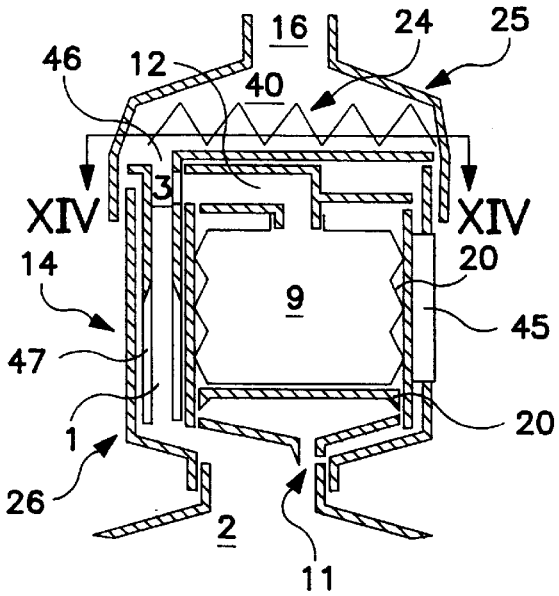
FIG. 10 is a diagrammatic illustration of an embodiment of the device according to the invention comprising a lower and upper part which is fitted onto a cartridge.

FIG. 10 is a schematic side elevation of one embodiment of the device according to the invention which is fitted onto a first chamber 2 shown here as the head of a commercially available cartridge. The device consists of a lower part 26 and an upper part 25. The stream of the first fluid medium issuing from the cartridge 2 is divided into two streams of which one is steered to the left towards the flow region 1 in the Figure while the second is steered to the right into the first opening 11 of the second chambers 9. The fluid medium entering the second chamber 9 flows against the separating element 20 and moves it upwards as the first medium continues to flow in. At the same time, it compresses another flexible separating means of element 20 in which the second fluid medium is stored. An opening of the flexible separating element 20 is sealingly connected to the second opening 12 of the second chamber 9 so that, when the flexible separating element 20 is compressed, the second fluid medium issues from the second opening 12.

The other stream of the first fluid medium flows into the flow region 1 into which a tube-like extension 47 of the upper part 25 projects. In the upper part of the flow region 1, the tube 47 has a lateral opening which is in alignment with the channel-like extension of the outlet 12. The first fluid medium and the second fluid medium combine with one another at this point 3. The outlet 46 of the combined fluid media is located immediately thereafter. From here the combined media flow through the mixing zone 40, in which a static mixer 24 is arranged, and then on to the outlet opening 16 of the device. The wall of the housing is transparent in the vicinity of the second chamber so that an inspection window 45 is formed.

Figure 12:
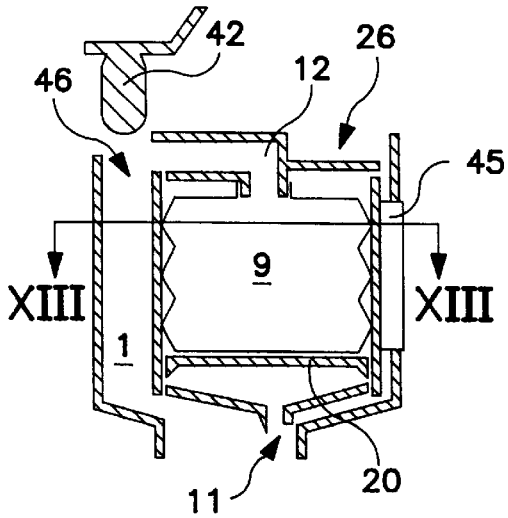
FIG. 12 is a diagrammatic illustration of the lower part illustrated in FIG. 10.
Figure 11:
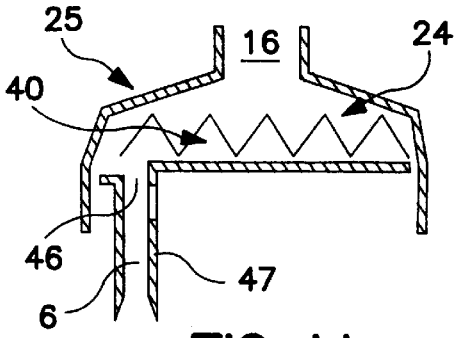
FIG. 11 is a diagrammatic illustration of the upper part illustrated in FIG. 10.

The lower part 26 and the upper part 25 of the housing 14 are shown separately in FIGS. 11 and 12. FIG. 12 also shows a closure element in the form of a plug 42 with which the lower part 26 can be closed when separated from the upper part 25 so that the unmixed media are kept separate from one another before use or even in the event of interruptions in application and are protected against flowing out or from unwanted contact with the environment.

Figure 13:
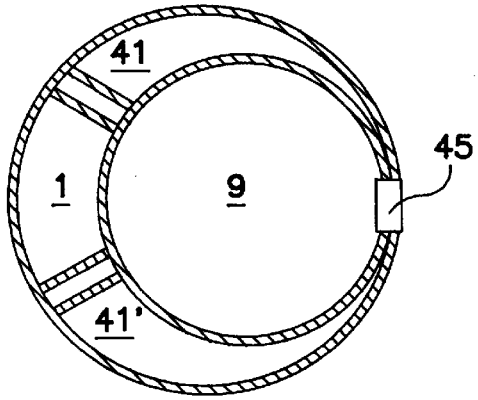
FIG. 13 is a plan view in section on the line XIII—XIII in FIG. 12.

FIG. 13, is a sectional plan view of the lower part 26, shows the arrangement of the various components in relation to one another. It can clearly be seen that the second chamber 9, which in this case has a round crosssection is arranged beside the flow region 1 which, in this case, has the crosssection of a radially limited ring segment. In the Figure can be seen spaces 41 in which siccatives, for example, can be accommodated. If these siccatives are to be effective, a connection must be provided between the space 41 and the fluid media. The inspection window 45 is also clearly visible.

Figure 14:
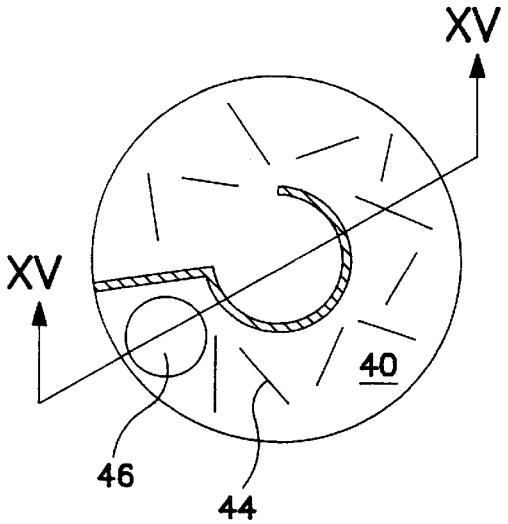
FIG. 14 is a plan view in section on the line XIV—XIV in FIG. 10.

FIG. 14 is a plan view of the upper part 25 in section on the line XIV—XIV. It can clearly be seen in FIGS. 14 and 15 that the combined media are guided from the outlet opening 46 into a channel-like mixing zone 40 which is formed by a partly circular wall connected to the outer wall immediately adjacent the outlet 46. Deflecting/turbulence elements 44 are shown in the mixing zone 40. When the combined media have passed through the mixing zone 40, they enter thoroughly mixed the central part of the mixing zone above which the outlet opening 16 of the device is located. If a very long mixing zone is required, the channel 40 can also be extended spirally over more than one plane before opening into the outlet 16.

Figure 16:
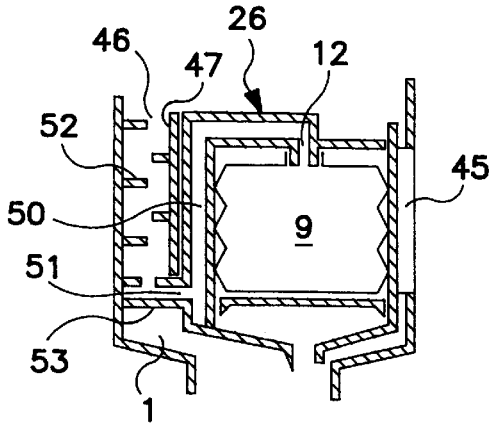
FIG. 16 is a schematic side elevation in section of an embodiment of the lower part of the device of the invention and FIG. 17 is a plan view in section of FIG. 16.

FIG. 16 shows the lower part 26 of another embodiment of the device according to the invention. The main difference between this embodiment and the embodiment shown in FIGS. 10 and 12 is that the second opening 12 of the second chamber 9 is connected to a channel 50 through which the second fluid medium is guided downwards against the general direction of flow. In its lower part, the channel 50 has an outlet opening 51 which aligns with a corresponding opening in the wall of the flow region 1. If the second fluid medium issues through the outlet opening 51 into the flow region 1, it is combined with the first fluid medium in the front part of the flow region 1 (in the direction of flow) and is guided upwards with the flow. Deflecting/turbulence elements 52 may be provided in the flow region 1 to premix the combined media before they enter the mixing zone 40 of the upper part 25 in the vicinity of the outlet 46.

Figure 17:
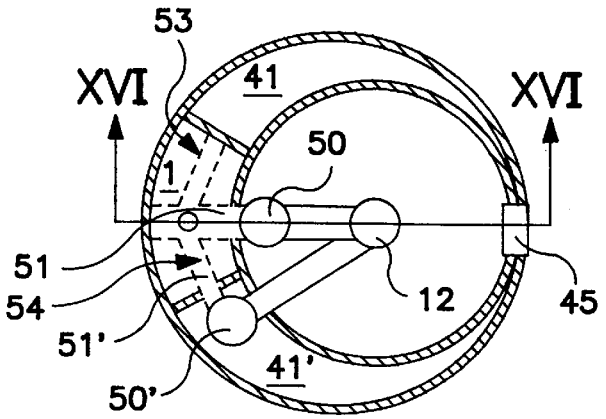

It can be seen that, through a correspondingly shaped deflecting element 53, which is best also arranged on the tube or separating element 47, the second fluid medium can also be guided into the middle of the stream of the first fluid medium which can be of advantage for certain consistencies of the two fluid media. FIG. 17, which is a plan view, shows that the channel on the one hand (50) can be can directly extended radially to the flow region 1 or on the other hand (50') can extend radially into a space 41' where a connection through the lateral partitions to the flow region 1 is provided.

Figure 15:
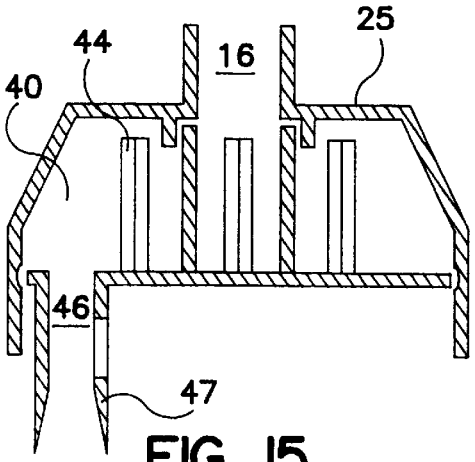
FIG. 15 is a side elevation in section on the line XV—XV in FIG. 14.

The tube-like extension 47 of the lower part 26 projecting into the flow region 1, which is shown in FIGS. 10, 11 and 15, is one possible embodiment of a separating element by which the parts of the lower part 26 are protected against direct contact with the combined fluid media. FIG. 15 also clearly shows that the upper part 25 may consist with advantage of two parts which are fitted rotatably into one another and thus enable the inner part to be fixed to the lower part 26 while the outer part of the upper part 25 is turned and is fixed to the lower part 26 either through a screwthread or through a bayonetlike closure.

FIGS. 16 and 17 show a deflecting element 53 which consists of hollow bars 54 and of which the inner channels communicate with the elements 12 and 50, 51 in which the second fluid medium is guided. The deflecting element (53) has the advantageous effect that the bars divide up the first fluid medium into individual streams which are squeezed by the window-like segments before re-combining with one another to form a strand behind the deflecting element (in the direction of flow). The second fluid medium which flows into the spaces between the individual strands at least at one point is uniformly distributed over a previous separating surface.

What is claimed is:

1. An apparatus for combining at least two fluid media, comprising: at least one first chamber with a first chamber opening, said first chamber adapted to be filled with a first fluid medium;

at least one flow region with at least one inlet opening and at least one outlet opening, wherein said flow region inlet opening is in open communication with said first chamber opening, wherein said flow region is adapted to accommodate said first fluid medium issuing from the first chamber and to transport a first portion of said first fluid medium to the outlet opening of the flow region; and at least one second chamber, adapted to be filled with a second fluid medium, comprising at least one second chamber first opening element, through which said second chamber is in open communication with said flow region, the second chamber first opening element arranged proximately to said first chamber; at least one second chamber second opening element distal to said first chamber, through which said second fluid medium is expelled to contact said first fluid medium, whereby said second fluid medium is expelled from said second chamber second opening element by the ingress of a second portion of the first fluid medium into the second chamber through second chamber first opening element.

2. An apparatus as claimed in claim 1, wherein the first opening element is arranged adjacent to a proximate part of the flow region in the direction of flow while the second opening element is arranged adjacent a distal part of the flow region in the direction of flow.

3. An apparatus as claimed in claim 1, wherein a channel leads from the second chamber second opening element into a part of the flow region proximate to the first chamber opening and is connected thereto by an outlet opening.

4. An apparatus as claimed in claim 1, wherein deflecting or turbulence elements for the combined fluid media are arranged in the flow region.

5. An apparatus as claimed in claim 1, wherein a distributor element is arranged in the second chamber.

6. An apparatus as claimed in claim 1, wherein a separating element is arranged between the first and second fluid media in the second chamber.

7. An apparatus as claimed in claim 6, wherein the separating element is relatively rigid, is arranged for movement in the second chamber, is sealed off from an inner wall thereof and comprises guide elements bearing against the inner wall of the second chamber.

8. An apparatus as claimed in claim 6, wherein the separating element is relatively rigid, is arranged for movement in the second chamber, is sealed off from an inner wall thereof and comprises pressure distributing segments on a side facing the first fluid medium.

9. An apparatus as claimed in claim 6, wherein the separating element is a flexible, elastic separating element.

10. An apparatus as claimed in claim 9, wherein the flexible, elastic separating element is sealingly fixed in an inner wall of the second chamber.

11. An apparatus as claimed in claim 6, wherein the separating element is arranged so that the second fluid medium can be accommodated therein.

12. An apparatus as claimed in claim 1, wherein a deflecting element of bars at least partly provided with inner channels, is arranged in the flow region, the bars extending perpendicularly to a direction of flow of the first fluid medium and having at least one opening on a flow shadow side, wherein the bars divide a cross-section of the flow region into several throughflow openings for the first fluid medium and the inner channels communicate with the channels carrying the second fluid medium.

13. An apparatus as claimed in claim 12, wherein the opening on the flow shadow side is centrally arranged.

14. An apparatus as claimed in claim 1, wherein the second chamber has a feed opening for the second fluid medium and a closure for the feed opening.

15. An apparatus as claimed in claim 1, wherein the second chamber and the flow region are arranged in a single housing.

16. An apparatus as claimed in claim 15, wherein the housing is round.

17. An apparatus as claimed in claim 15, wherein the housing consists of a lower part and an upper part, the upper part being designed to be fixed to the lower part.

18. An apparatus as claimed in claim 17, wherein the upper part and lower part of the housing are delimited in such a way that only parts of the upper part are in contact with a mixed fluid media.

19. An apparatus as claimed in claim 17, wherein a shut-off element is provided for at least one of the outlet openings of the flow region and the second chamber second opening element and closes at least one of the outlet openings when the upper part is removed.

20. An apparatus as claimed in claim 19, wherein the shut-off element closes at least one of the outlet openings automatically when the upper part is removed.

21. An apparatus as claimed in claim 17, wherein at least one of the outlets for the unmixed fluid media is designed to be closed when the upper part is removed.

22. An apparatus as claimed in claim 21, wherein at least one of the outlet openings of the flow region and second chamber second opening element for the unmixed fluid media is arranged to be closed by plug means, when the upper part is removed.

23. An apparatus as claimed in claim 15, wherein the second chamber is arranged annularly around the flow region and comprises a single chamber or of several sector-like chambers.

24. An apparatus as claimed in claim 23, wherein the second chamber is arranged annularly and centrally around the flow region.

25. An apparatus as claimed in claim 15, wherein the second chamber is arranged beside the flow region in the housing.

26. An apparatus as claimed in claim 25, wherein the second chamber is surrounded at least partly annularly by the flow region in the housing.

27. An apparatus as claimed in claim 1, arranged so that after the first and second fluid media have been combined, the combined first and second fluid media pass to an integrated or fixed mixing zone is arranged in the vicinity of the outlet opening, wherein a mixer is arranged in the mixing zone.

28. An apparatus as claimed in claim 27, wherein the mixer is arranged so that the combined fluid media are guided to a centrally arranged outlet opening through a channel which is arranged at an angle to a direction of flow and into a cross-section of which project deflecting elements wherein the channel extends spirally from a peripheral outlet for the combined fluid media to the central outlet opening, largely covering at least the area of one plane of a mixing zone.

29. An apparatus as claimed claim 1, wherein the flow region has an adjustable flow cross-section.

30. An apparatus as claimed in claim 1, wherein a spring element designed to bend under pressure in the direction of flow of the second fluid medium is provided at the outlet of the second chamber second opening element, thereby closing the outlet in its unbent position.

31. An apparatus as claimed in claim 1, wherein at least one wall projection by which the first fluid medium is partly diverted is arranged to form one edge of the second chamber first opening element in communication With the flow region.

32. An apparatus as claimed in claim 1, at least partly arranged in a housing wherein outer walls of the housing are insulating.

33. An apparatus as claimed in claim 32, wherein the insulating outer walls of the housing are of double-walled construction wherein the outer wall is at least partly transparent in the vicinity of the second chamber and at least one space for effectively accommodating siccatives is provided in the housing.

34. An apparatus comprising: an apparatus for combining fluids of claim 1 wherein the mixture of the first and second fluid media can be fed from an outlet opening, a second apparatus of claim 1 arranged in cascade-fashion to accept the mixture of the first and second fluid media from the outlet opening into the flow region of the second apparatus of claim 1, into a chamber for a third fluid medium whereby a mixture comprising at least three components can be formed.

35. A method for combining at least two separately stored fluid media which comprises: imparting energy to a first fluid medium selected from the group consisting of adhesives, sealants and mixtures thereof, in a first storage chamber to cause flow of the first fluid medium from the first storage chamber, whereby, the flow energy of the flowing first fluid medium causes at least one second fluid medium to flow from a second storage chamber and the second fluid medium which flows from the send storage chamber is mixed with the flowing first fluid medium.

36. The method as claimed in claim 35, wherein the flowing first fluid medium enters the second storage chamber and provides a pressure which is applied to the second fluid medium to force the second fluid medium from the second storage chamber.

37. The method as claimed in claim 36, wherein the flowing first fluid medium produces a reduced pressure at a second storage chamber outlet to the at least second fluid medium which causes the second fluid medium to flow from the second storage chamber.

38. The method as claimed in claim 35, wherein the pressure to be applied to the at least second fluid medium, and generated by the energy of the flowing first fluid medium, is controlled so that the at least one second fluid medium is expressed with the first fluid medium in a predetermined ratio.

39. The method as claimed in claim 35, wherein the at least two fluid media are mixed after they have been combined and before they are expressed from a mixing element.

40. The method as claimed in claim 35, wherein the first fluid medium is a basic adhesive or sealant component and the at least one second fluid medium is selected from the group consisting of catalysts, crosslinking agents, coloring agents and mixtures thereof wherein the at least one second fluid medium is continuously added to and mixed with the basic component in a small quantity relative to the basic component.

41. The method as claimed in claim 40, wherein the basic component comprises a one component moisture-curing adhesive or sealant and the at least one second fluid medium is added to the basic component in a quantity of about 0.5 to about 8% by weight, based on the basic component.

42. The method as claimed in claim 40, wherein the basic component is selected from the group consisting of polyurethanes containing reactive isocyanate groups, polydimethylsiloxanes, alkoxysilane-terminated polyethers, adhesives containing reactive epoxide groups, sealants containing reactive epoxide groups and mixtures thereof.

43. The method as claimed in claim 40, wherein the at least one second fluid medium is selected from the group consisting of organotin compounds, tertiary amines, water, organic diamines, organic triamines, alkanolamines, polyols and mixtures thereof and wherein the mixing of the components is completed in a static mixing zone.

44. The method as claimed in claim 40, wherein the basic component is contained in a first chamber comprising a commercially available cartridge for adhesives or sealants and the at least one second fluid medium is contained in a second chamber in an adapter fitted to the cartridge.

* * * * *

UNITED STATES PATENT AND TRADEMARK OFFICE

CERTIFICATE OF CORRECTION

PATENT NO. : 6,079,871
DATED : June 27, 2000
INVENTOR(S) : Jonas et al.

It is certified that error appears in the above-identified patent and that said Letters Patent is hereby corrected as shown below:

Column 18,
Line 31, after "zone", delete "is".
Line 53, delete "With" and insert therefor -- with --.
Line 67, after "claim 1", insert -- , --.

Column 19,
Line 13, delete "send", and insert therefor -- second --.

Signed and Sealed this

Fourteenth Day of October, 2003

JAMES E. ROGAN
*Director of the United States Patent and Trademark Office*